US008859877B2

(12) United States Patent
Oba et al.

(10) Patent No.: US 8,859,877 B2
(45) Date of Patent: Oct. 14, 2014

(54) DAMPER DRIVE DEVICE FOR MUSICAL INSTRUMENT, AND MUSICAL INSTRUMENT

(71) Applicant: Yamaha Corporation, Hamamatsu (JP)

(72) Inventors: Yasuhiko Oba, Hamamatsu (JP); Yuji Fujiwara, Hamamatsu (JP); Yoshiya Matsuo, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 13/744,770

(22) Filed: Jan. 18, 2013

(65) Prior Publication Data

US 2013/0180391 A1 Jul. 18, 2013

(30) Foreign Application Priority Data

Jan. 18, 2012 (JP) ..... 2012-008402
Jan. 18, 2012 (JP) ..... 2012-008403

(51) Int. Cl.
*G10H 1/32* (2006.01)
*G10H 3/00* (2006.01)

(52) U.S. Cl.
USPC ..... 84/746; 84/737; 84/216

(58) Field of Classification Search
USPC ..... 84/746, 737, 216–218
See application file for complete search history.

(56) References Cited

U.S. PATENT DOCUMENTS 4,106,386 A * 8/1978 Rotramel et al. ..... 84/256
5,523,522 A * 6/1996 Koseki et al. ..... 84/21
5,663,513 A * 9/1997 Sugiyama et al. ..... 84/21
6,348,645 B1 * 2/2002 Yamashita ..... 84/217
6,417,440 B2 * 7/2002 Furuki ..... 84/719
6,423,889 B2 * 7/2002 Inoue ..... 84/236
7,238,873 B2 7/2007 Fujiwara et al.
7,388,142 B2 * 6/2008 Daigle ..... 84/285
7,851,690 B1 12/2010 Stahnke
8,067,685 B2 * 11/2011 Parish ..... 84/726
2002/0020278 A1 * 2/2002 Yamashita ..... 84/217
2013/0180377 A1 * 7/2013 Oba et al. ..... 84/229

FOREIGN PATENT DOCUMENTS

EP 1152391 A2 11/2001
JP 2001-318666 A 11/2001
JP 2002-014669 A 1/2002
JP 2005-250120 A 9/2005

OTHER PUBLICATIONS

Korean Office Action for corresponding KR10-2013-5207, mail date Feb. 21, 2014. English translation provided.
Extended European Search Report for corresponding EP 13012001.7, dated Jun. 26, 2014.

* cited by examiner

*Primary Examiner* — Jeffrey Donels
(74) *Attorney, Agent, or Firm* — Rossi, Kimms & McDowell LLP

(57) ABSTRACT

An elongated lifting rail is displaceable to collectively pivot a plurality of damper levers. An actuator is provided beside or underneath the lifting rail for automatically displacing the lifting rail. The lifting rail is displaced, in response to driving of the actuator, to displace the damper levers so that the dampers are moved away from contact with sounding members. Further, a position sensor is provided for detecting a displaced position of the lifting rail, so that position data detected by the position sensor is used for operating position control and/or operating position recording of the dampers.

15 Claims, 10 Drawing Sheets

DAMPER DRIVE DEVICE FOR MUSICAL INSTRUMENT, AND MUSICAL INSTRUMENT

BACKGROUND

The present invention relates to techniques for driving dampers for a musical instrument (typically a keyboard musical instrument) and more particularly to a technique for processing data related to dampers.

Damper mechanisms for damping vibration of strings in a piano have been known, and normally, dampers are driven in response to damper pedal operation performed by a human player (or user). In pianos equipped with an automatic performance function, on the other hand, dampers can be automatically driven by an actuator. One example of such an automatic damper drive device is disclosed in Japanese Patent Application Laid-open Publication No. 2002-14669. In the automatic damper drive device disclosed in the No. 2002-14669 publication, an electromagnetic solenoid (actuator) is disposed at a position spaced a considerable distance laterally from a lifting rail provided for collectively or integrally moving a plurality of dampers, and in such a manner that a plunger of the electromagnetic solenoid is driven downwardly. The electromagnetic solenoid is also constructed in such a manner that the plunger downwardly abuts against one end of a loud lever supported at a pivot point and a lifting rod abuts against the upper surface, opposite from the pivot point, of the loud lever. As the electromagnetic solenoid is energized to downwardly depress the plunger, the one end of the loud lever descends or moves downward, so that the loud lever pivots about the pivot point to push upwardly the lifting rod. As the lifting rod is pushed upward like this, the lifting rail contacting the upper end of the lifting rod is pushed upward. In this manner, the dampers are moved out of contact with strings so that the strings will vibrate long (damper-off mode). Further, in the prior art construction, a lever returning spring is provided in association with the loud lever, and this lever returning spring normally urges or biases the loud lever in a direction opposite from the direction in which the lifting rod is pushed upward. Thus, once the energization of the electromagnetic solenoid is terminated, the loud lever returns to its original position by the biasing force of the lever return spring so that the dampers press against the strings (damper-on mode).

With the aforementioned prior art technique, the dampers are automatically drivable by the actuator (electromagnetic solenoid). However, because the loud lever is driven by the actuator (electromagnetic solenoid), the actuator (electromagnetic solenoid) has to drive the loud lever against the biasing force of the lever return spring provided in association with the loud lever, which would impose a great load on the actuator (electromagnetic solenoid).

Japanese Patent Application Laid-open Publication No. 2005-250120 too discloses a player piano where dampers are driven by an actuator. The player piano disclosed in the No. 2005-250120 publication includes a position sensor for detecting a depressed position of a loud pedal (i.e., damper pedal), and a solenoid for driving the loud pedal. The solenoid has a plunger connected to the loud pedal, and the position of the dampers is controlled by driving the solenoid through servo control using performance data of a MIDI (Musical Instrument Digital Interface) format and a result of the detection of the position sensor.

In such player pianos, a mechanism for transmitting motion of the loud pedal to dampers comprises a plurality of component parts disposed between the loud pedal (damper pedal) to the dampers, and the dampers are ultimately displaced or moved by the plurality of component parts changing a force transmitting direction and amount of displacement. Because the operating position of the dampers changes in response to user's depressing operation of the loud pedal, detection of a depressed position of the loud pedal can be said to be indirect detection of an operating position of the dampers. However, because the loud pedal and the dampers differ from each other in amount of physical displacement (i.e., physical displacement amount) and because some allowance exists between some of adjoining component parts within a force transmission route, it is difficult to accurately detect a position of the dampers by detecting a depressed position of the loud pedal (i.e., damper pedal). Thus, when the dampers (damper pedal) are to be automatically moved in accordance with performance data, there is a need to perform accurate positioning control of the loud pedal taking into account the aforementioned allowance and displacement amount difference (transmission error), which would make it difficult to accurately control the operating position of the dampers.

SUMMARY OF THE INVENTION

In view of the foregoing prior art problems, it is an object of the present invention to provide a technique which allows dampers to be moved with reduced force when the dampers are to be automatically driven by an actuator. It is another object of the present invention to provide a technique which can accurately detect an operating position of dampers in a musical instrument.

In order accomplish the above-mentioned objects, the present invention provides an improved damper drive device for a musical instrument, which comprises: a plurality of dampers each configured to be displaceable to damp vibration of a corresponding sounding member of the musical instrument; a plurality of damper levers each configured to be pivotable to displace a corresponding one of the dampers; an elongated member configured to be displaceable to collectively pivot the plurality of damper levers; and an actuator disposed beside or underneath the elongated member for displacing the elongated member. The elongated member is displaced in response to driving of the actuator so that the dampers are displaced away from contact with the sounding members.

In the damper drive device of the present invention, the actuator is disposed beside or underneath the elongated member, and the elongated member is displaced in response to driving of the actuator. Thus, the actuator can be disposed in a route where biasing force of a lever return spring does not intervene. In this way, when the dampers are to be driven by the actuator, they can be driven to be moved with reduced force, as a result of which it is possible to significantly reduce a load that would be imposed on the actuator.

In an embodiment, the actuator is disposed beside or immediately underneath the elongated member, and motion of the actuator may be transmitted to the elongated member to apply driving force to a longitudinal edge portion of the elongated member so that the elongated member pivots about the longitudinal axis thereof. Preferably, the actuator is disposed beside the elongated member, and a connection member may be mounted to the elongated member and projecting generally laterally from the longitudinal edge portion of the elongated member so as to transmit motion of the actuator to the elongated member, so that the driving force is applied to the longitudinal edge portion of the elongated member by the actuator driving the connection member. As another example, the actuator may be disposed at a halfway position of a lifting rod vertically movable for transmitting motion of a user-operated damper pedal to the elongated member, so that the lifting rod is moved upwardly, in response to upward movement of the actuator, to thereby displace the elongated member. As another example, the actuator may be disposed beside a lifting rod vertically movable for transmitting motion of the user-operated damper pedal to the elongated member so that motion of the actuator is transmitted to the lifting rod via a transmission member to thereby displace the elongated member. As still another example, the actuator may be disposed underneath the elongated member, and a transmission rod may be provided between the actuator and the elongated member for transmitting motion of the actuator to the elongated member so that motion of the actuator is transmitted the elongated member via the transmission rod.

According to another aspect of the present invention, there is provided a musical instrument, which comprises: a plurality of sounding members; a plurality of dampers each configured to be displaceable to damp vibration of any one of the sounding members; a plurality of damper levers each configured to be pivotable to displace a corresponding one of the dampers; an elongated member configured to be displaceable to collectively pivot the plurality of damper levers; a damper pedal operable by a user; a pedal mechanism configured to displace the elongated member in response to depressing operation of the damper pedal so that the dampers are displaced away from contact with the sounding members; and a sensor configured to detect a displaced position of the elongated member. Because the sensor is constructed to detect a displaced position of the elongated member closer to the sensor than the dampers, it is possible to detect an operating position of the dampers with an increased accuracy.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION

Figure 1:
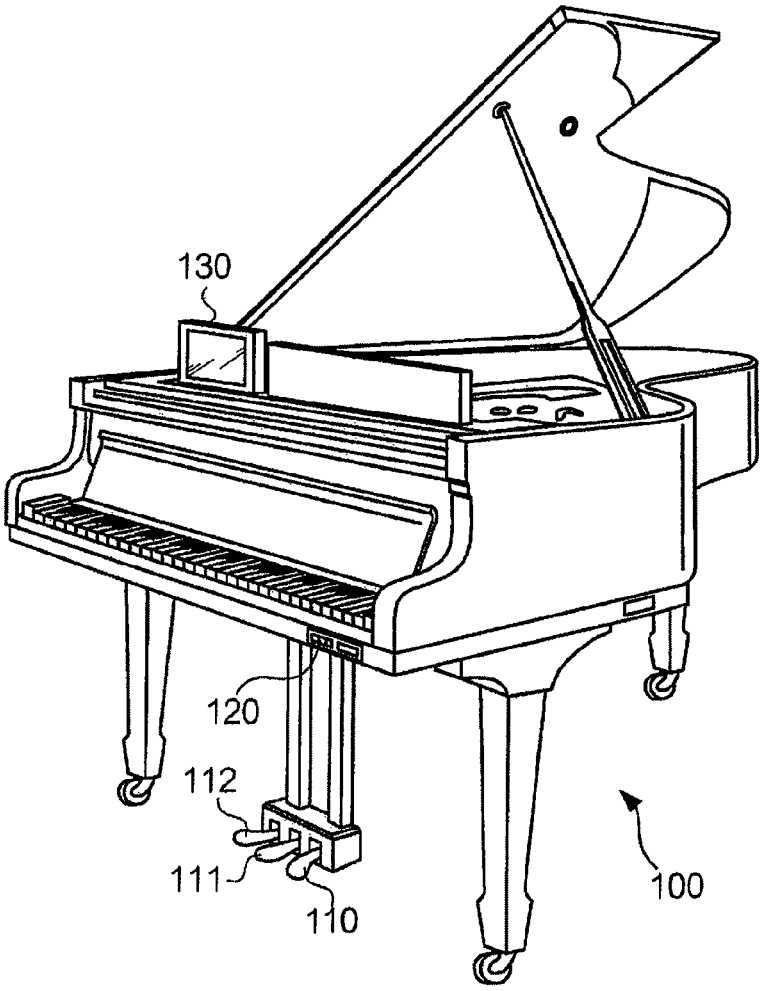
FIG. 1 is a perspective view showing an outer appearance of a player piano with an automatic performance function according to a preferred embodiment of the present invention.

FIG. 1 is a perspective view showing an outer appearance of a grand piano 100 with an automatic performance function (i.e., player piano) according to an embodiment of the present invention. The piano 100 includes a plurality of keys 1 provided on its front side facing a human player or user, and a damper pedal 110, sostenuto pedal 111 and soft pedal 112 provided beneath the keys 1. The piano 100 further includes an access section 120 for reading out performance data from a recording medium, such as a DVD (Digital Versatile Disk) or CD (Compact Disk), having stored therein performance data of a MIDI format, and it also includes, beside a music stand, a liquid crystal display for displaying, among other things, various menu screens for manipulating the automatic performance function of the piano 100, and an operation panel 130 having a touch panel that functions as a reception means for receiving various instructions from a human operator.

Figure 2:
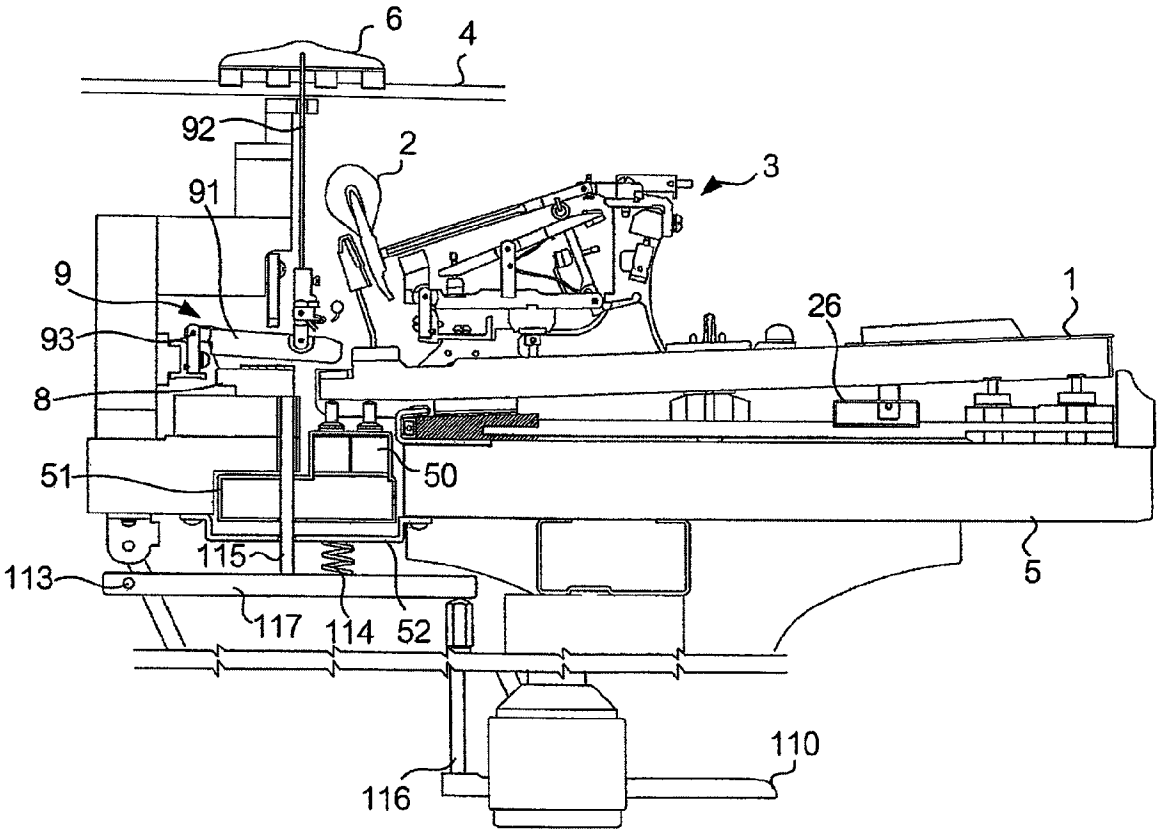
FIG. 2 is a side view schematically showing an inner construction of the player piano shown in FIG. 1.

FIG. 2 is a schematic side view showing an inner mechanical construction of the player piano 100. For each of the keys 1, the player piano 100 includes, among other things, a hammer action mechanism 3, a solenoid 50 for driving the key 1, a key sensor 26, and a damper mechanism 9 for moving a damper 6. The right side in FIG. 2 is the front side of the piano 100 as viewed from a human player, while the left side in FIG. 2 is the rear side of the piano 100 as viewed from the human player. Although only one key 1 is shown in FIG. 2, eighty-eight (88) such keys 1 are provided side by side in a left-right direction as viewed from the human player. Accordingly, eighty-eight hammer action mechanisms 3 and eighty-eight key sensors 26 are provided in corresponding relation to the eighty-eight keys 1. Also, eighty-eight solenoids 50 are provided in corresponding relation to the eighty-eight keys 1, one solenoid 50 per key 1. As viewed from above (i.e., as viewed in top plan), the eighty-eight solenoids 50 are arranged in two rows, i.e. front-side and rear-side horizontal rows, forty-four solenoids 50 in the front-side horizontal row and forty-four solenoids 50 in the rear-side horizontal row. Although it appears in FIG. 2 as if two solenoids 50 are provided per key 1, the front-side solenoid 50 is for (i.e., corresponds to) the key 1 shown in the figure, and the rear-side solenoid 50 located to the left of the front-side solenoid 50 is for another key 1 adjoining that key 1 shown in the figure.

As well known, each of the keys 1 is pivotably supported for depressing operation by the human player. Each of the hammer action mechanisms 3 having hammers 2 is a mechanism for hitting strings (i.e., sounding members) 4 provided in corresponding relation to the key 1. As the key 1 is depressed by the human player, the hammer 2 hits the strings 4 in response to motion of the key 1. In an automatic performance, each of the solenoids 50 is used for automatically driving the corresponding key 1. The solenoid 50 is accommodated in a case 51 that is provided in a hole formed in a keybed 5 of the piano 100. The hole formed in the keybed 5 is covered with a cover 52. Once a solenoid-driving signal is supplied to the solenoid 50, the plunger of the solenoid 50 is displaced. As the plunger is displaced to push the key 1 upwardly, the hammer 2 hits the strings 4 in response to the motion of the key 1. The key sensor 26 is provided below a front (right in FIG. 2) end portion of the key 1 for detecting a kinetic state, such as a position or velocity, of the key and outputs a signal indicative of the detected kinetic state.

A damper pedal 110 is a pedal for moving the dampers 6. In FIG. 2, a front end portion (right end portion in the figure) of the damper pedal 110 is depressed or operated by a human player's foot. In the illustrated example of FIG. 2, a pedal rod 116 is connected to a rear end portion (left end portion in the figure) of the damper pedal 110. The pedal rod 116 has and upper end contacting the lower surface of a front end portion (right end portion in the figure) of a damper pedal lever 117. The damper pedal lever 117 is pivotally supported by a pin 113 so that it can pivot about the pin 113. A spring 114 that is a resilient member for returning the damper pedal lever 117 and the damper pedal 110 to their original position and a lifting rod 115 are fixed in contact with the upper surface of the damper pedal lever 117.

The spring 114, which is for example a metal coil spring, has an upper end contacting the cover 52. The spring 114 normally urges the damper pedal lever 117 in such a direction as to pivot clockwise (downward) about the pin 113. Note that any other resilient member, such as rubber, may replace the metal spring 114 as long as it imparts the damper pedal lever 117 with biasing force that causes the damper pedal lever 117 to pivot clockwise about the pin 113. The lifting rod 115 has an upper end contacting the lower surface of a lifting rail 8 that is an elongated member extending horizontally along the row of the keys 1 through holes formed in the cover 52, case 51 and keybed 5. The lifting rail (elongated member) 8 is provided for moving the damper mechanisms 9. More specifically, the lifting rail 8 is disposed underneath the damper mechanisms 9 corresponding to the individual keys 1, and it is a bar-shaped component part extending in the left-right direction as viewed from the human player.

Each of the damper mechanisms 9, provided for moving the dampers 6, includes a damper lever 91 and a damper wire 92. The damper lever 91 is pivotably supported at one end by a pin 93, and the damper wire 92 is connected at one end (lower end in FIG. 2) to the other end of the damper lever 91. The damper wire 92 is connected at the other end (upper end in FIG. 2), opposite from the one end, to the damper 6. Namely, in the piano 100, a plurality of displaceable dampers 6 and a plurality of damper levers 91 pivotable for vertically displacing the dampers 6 are provided for damping vibration of corresponding ones of the strings (sounding members) 4.

When the human player is not touching the damper pedal 110, the damper pedal lever 117 and the pedal rod 116 are kept resiliently depressed downward by the spring 114, so that a front end portion of the damper pedal 110 is located at a predetermined position. As the human player steps on the front end portion of the damper pedal 110 against the biasing force of the spring 114, a rear end portion of the damper pedal 110 moves upward to cause the pedal rod 116 to move up. By such upward motion of the pedal rod 116, the front end portion of the damper pedal lever 117 is pushed upward so that the damper pedal lever 117 pivots counterclockwise, so that the lifting rod 115 is pushed upward. As the lifting rod 115 is pushed upward like this, the lifting rail (elongated member) 8 is pushed upward. The lifting rail (elongated member) 8 pushed upward like this abuts against the plurality of damper levers 91 to collectively pivot the damper levers 91. As the damper levers 91 pivot like this, each of the damper wire 92 is pushed upward, so that each of the dampers 6 moves away from the contact with the corresponding strings 4. Namely, the lifting rail (elongated member) 8 is constructed to be displaceable for collectively pivot the plurality of damper levers 91.

Further, as the human player releases the foot from the damper pedal 110, the front end portion of the damper pedal lever 117 moves downward by the biasing force of the spring 114, thereby depressing the pedal rod 116. In response to the depression of the pedal rod 116, the rear end portion of the damper pedal 110 moves downward, so that the front end portion of the damper pedal 110 returns to the original position. Also, as the front end portion of the damper pedal lever 117 moves down, the lifting rod 115 moves downward, so that the lifting rail 8 also moves downward. Then, the plurality of damper levers 91 pivot downward together, in response to which the corresponding damper wires 91 move downward so that each of the dampers 6 holds the corresponding strings 4.

Figure 3:
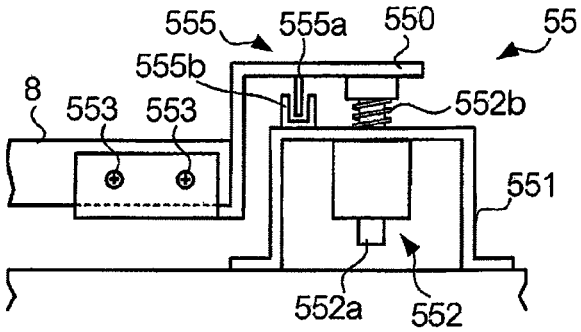
FIG. 3 is a front view showing an example construction of a rail drive section for collectively driving a plurality of damper levers.

The following describe a construction for driving the lifting rail (elongated member) 8 by use of an actuator. FIG. 3 is a front view of a rail drive section 55 provided on any one of longitudinal end portions of the lifting rail (elongated member) 8 for driving the lifting rail 8. The rail drive section 55 includes a connection member (or transmission member) 550, a frame 551, a solenoid 552 that is an example of the actuator, and screws 553. Whereas, in the illustrated example, the rail drive section 55 is provided on a right end portion of the lifting rail 8 as viewed from the human, the rail drive section 55 may be provided on a left end portion of the lifting rail 8 as viewed from the human player.

Figure 4:
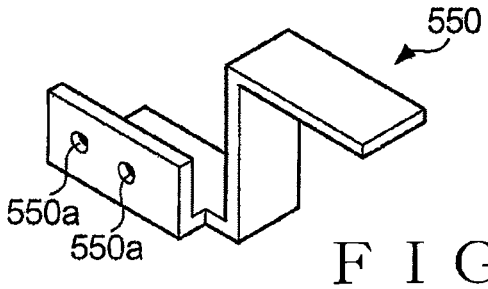
FIG. 4 is a perspective view showing an example of a connection member for transmitting driving force of an actuator to a lifting rail (elongated member)

The connection member 550 is a transmission member for transmitting motion of the actuator (solenoid) 552 to the lifting rail (elongated member) 8, which is provided on a front-side longitudinal edge portion of the lifting rail 8 and projects substantially laterally from the right end of the lifting rail 8. More specifically, the connection member 550 is formed in a stepwise shape by bending a flat metal piece vertically upward at one position a predetermined distance from one end thereof and then bending the metal piece horizontally at another position a predetermined distance from the one position, as shown in FIG. 4. A portion of a lower front side region of the stepwise-shaped flat metal piece is bent vertically upward, and such a vertically-bent portion has holes 550*a* formed therein for passage therethrough of screws 553. The connection member 550 is fixed to a right end region of a front-side longitudinal edge portion of the lifting rail 8 by means of the screws 553 passed through the 550*a*. Note that the connection member 550 may be formed of any other suitable material than metal, such as synthetic resin or wood. Further, the connection member 550 may be fixed to the lifting rail 8 by an adhesive rather than the screws 553. The connection member 550 functions as a transmission means for transmitting linear motion of a later-described plunger 552*a* to the lifting rail 8.

The frame 551, which is a member for fixedly positioning the electromagnetic solenoid (actuator) 552, is fixed to the upper surface of the keybed 5 immediately laterally beside a right end portion of the lifting rail (elongated member) 8. The frame 551 had a hole formed therein for passage therethrough of the plunger 552*a* of the solenoid (actuator) 552. With the solenoid 552 fixed to the frame 551, the solenoid 552 is located at a distance above the keybed 5 as shown in FIG. 3, and one end of the plunger 552*a* projects upwardly beyond the frame 551. Note that the frame 551 too may be formed of any other suitable material than metal, such as synthetic resin or wood.

The solenoid 552 includes the plunger 552*a* and a spring 552*b*. The plunger 552*a* extends through a frame of the solenoid 552*a* and has the one end contacting the underside of an upper portion of the stepwise-shaped connection member 550. While no electric current is flowing through the solenoid 552, the plunger 552*a* is held in contact with the connection member 550 by the biasing force of the spring 552*b*. Once an electric current flows through the solenoid 552, the plunger 552*a* moves upwardly to push upwardly the connection member 550, in response to which the lifting rail 8 having the connection member 550 fixed thereto moves upwardly. Specifically, a front-side longitudinal edge portion of the lifting rail 8 moves upwardly so that the lifting rail 8 pivots about its imaginary longitudinal axis. Namely, the actuator (solenoid) 552 is arranged to apply its driving force to the front-side longitudinal edge portion of the lifting rail 8 in such a manner that the lifting rail 8 pivots about its imaginary longitudinal axis of the lifting rail 8. More specifically, in order to transmit the motion of the actuator (solenoid) 552 to the lifting rail (elongated member) 8, the connection member 550 is fixed to the lifting rail 8 in such a manner as to project generally laterally beyond one end of the longitudinal edge portion of the lifting rail 8, and the connection member 550 is driven by the actuator (solenoid) 552 so that the driving force of the actuator (solenoid) 552 acts on the lifting rail (elongated member) 8 via the connection member 550. Note that the solenoid 552 may be a push-type solenoid that does not have the spring 552*b*.

A position sensor 555 is provided in association with the frame 551. The position sensor 555 includes a transparent or light-permeable plate 555*a* and a detection section 555*b* so that it functions as a sensor for detecting a displaced position of the lifting rail (elongated member) 8. The light-permeable plate 555*a* is a plate-shaped member formed of light-permeable synthetic resin. The light-permeable plate 555*a* is processed in such a manner that an amount of light permeable therethrough differs depending on a position of the light-permeable plate 555*a*, i.e. in such a manner that the amount of light permeable through the light-permeable plate 555*a* increases as the light-permeable plate 555*a* gets farther from the connection member 550. The detection section 555*b* is a photo sensor comprising a combination of a light emitting portion and a light receiving portion. Light emitted from the light emitting portion transmits through the light-permeable plate 555*a* and is received by the light receiving portion. The detection section 555*b* outputs an analog signal ya corresponding to an amount of the light received by the light receiving portion. With such arrangements, the amount of light transmitted through the light-permeable plate 555*a* and reaching the light receiving portion varies as the position of the lifting rail 8 varies in the vertical (or up-down) direction. Thus, the analog signal ya output from the detection section 555*b* varies in response to a variation of the vertical position (i.e., position in the up-down direction) of the lifting rail 8 and indicates a current vertical position of the lifting rail 8.

Namely, the electromagnetic solenoid (actuator) 552 is disposed laterally beside (i.e., near one (right or left) longitudinal end of) the lifting rail (elongated member) 8 so that it can easily drive the lifting rail (elongated member) 8. Further, even where the electromagnetic solenoid (actuator) 552 drives the lifting rail (elongated member) 8 indirectly via the transmission means like this, a driving-force transmission route from the electromagnetic solenoid (actuator) 552 to the lifting rail (elongated member) 8 can be extremely short. Because of such an installed position of the electromagnetic solenoid 552, the biasing force of the returning spring 114 of FIG. 114 does not act on the driving-force transmission route from the electromagnetic solenoid (actuator) 552 to the lifting rail (elongated member) 8 and thus would not impose a load on the electromagnetic solenoid (actuator) 552. As an alternative, the electromagnetic solenoid (actuator) 552 may be disposed immediately below the lifting rail (elongated member) 8 rather than beside (i.e., near the left or right end of) the lifting rail (elongated member) 8. In such an alternative too, the biasing force of the returning spring 114 of FIG. 114 does not act on the driving-force transmission route from the electromagnetic solenoid (actuator) 552 to the lifting rail (elongated member) 8 and thus would not impose a load on the electromagnetic solenoid (actuator) 552. As another alternative, the electromagnetic solenoid (actuator) 552 may be disposed in front of the front-side longitudinal edge of the lifting rail 8 (i.e., beside an end portion of the front-side longitudinal edge of the lifting rail 8 as viewed from a side of the piano) rather than laterally beside (i.e., near the right or left end of) the lifting rail 8.

Figure 5:
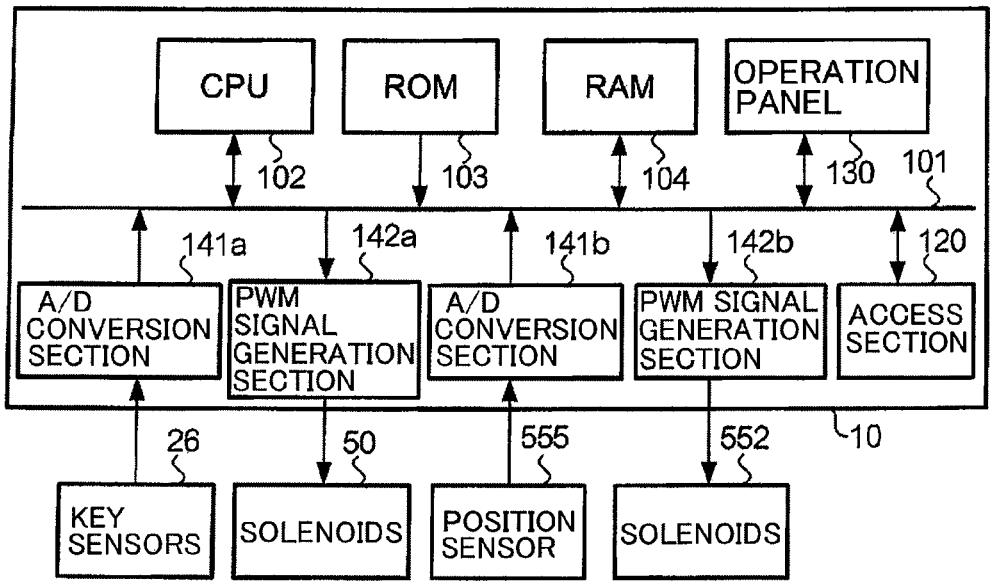
FIG. 5 is a schematic block diagram, showing an example construction of electric/electronic circuitry of the player piano.

Next, with reference to FIG. 5, a description will be given about an example electrical/electronic setup of the grand piano 100. More specifically, FIG. 5 is a schematic block diagram of a controller 10 which executes an automatic performance by controlling the aforementioned solenoid 552. As shown in FIG. 5, the controller 10 includes a CPU (Central Processing Unit) 102, a ROM (Read-Only Memory) 103, a RAM (Random Access Memory) 104, the access section 120 and the operation panel 130, and these components are connected to a bus 101. The controller 10 also includes A/D conversion sections 141*a* and 141*b* and PWM (Pulse Width Modulation) signal generation sections 142*a* and 142*b* connected to the bus 101, and the controller 10 controls the solenoids 50 and 552 using these components.

The A/D conversion section 141 a converts an analog signal output from any one of the key sensors 26 to a digital signal and outputs the converted digital signal to a motion controller 1000*a*. The digital signal is indicative of a vertical position of the corresponding key 1 that varies in response to a performance operation.

The A/D conversion section 141*b* converts an analog signal output from the position sensor 555 to a digital signal and outputs the converted digital signal to a motion controller 1000*b*. Because the signal output from the position sensor 555 is indicative of a vertical position of the lifting rail 8 as noted above, the converted digital signal yd too is indicative of the vertical position of the lifting rail 8.

The CPU 102 executes a control program, stored in the ROM 103, using the RAM 104 as a working area. By the execution of the control program stored in the ROM 103, the automatic performance function is implemented in which the solenoids are driven in accordance with performance data read out from a recording medium inserted in the access section 120.

Figure 6:
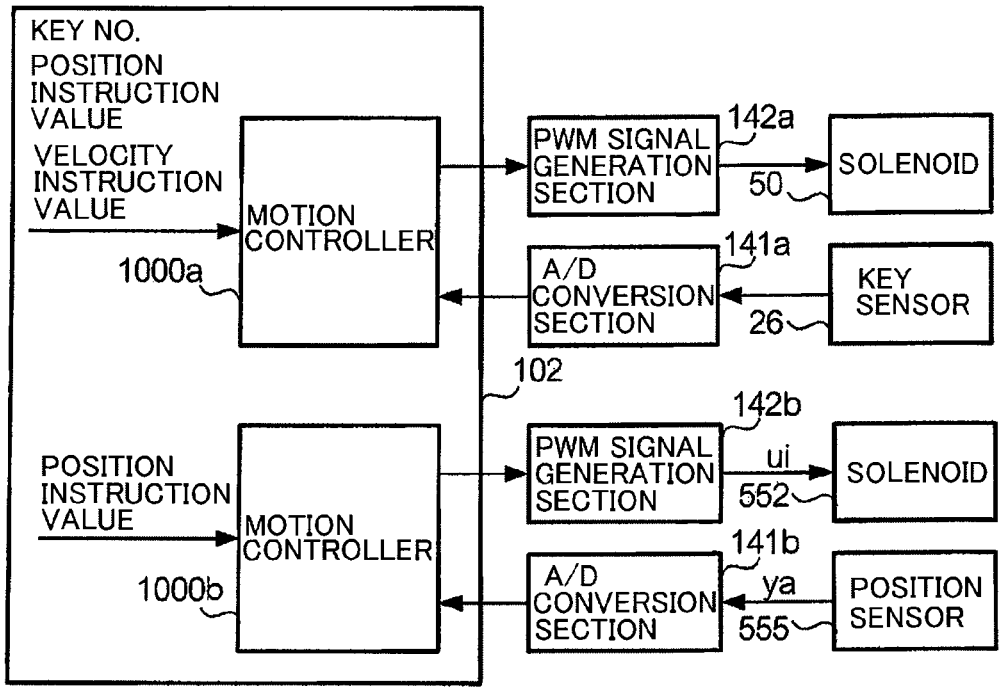
FIG. 6 is a schematic block diagram showing functional arrangements related to the automatic performance function of the player piano.

FIG. 6 is a schematic block diagram showing functional arrangements related to the automatic performance function. As shown in FIG. 6, the motion controllers 1000*a* and 1000*b* are implemented in the CPU 102.

The motion controller 1000*a* controls motion of the keys 1. In an automatic performance, the CPU 102 calculates, on the basis of performance data of the MIDI format acquired from the recording medium, at which timing a given key 1 should be driven or moved, and then it generates trajectory data indicative of a trajectory of the key 1 corresponding to the passage of time. Then, on the basis of the trajectory data, the CPU 102 supplies the motion controller 1000*a* with a key number indicative of the key 1 to be driven, a position instruction value indicative of a position of the key 1 to be driven and a velocity instruction value indicative of a velocity of the key 1 to be driven.

Upon receipt of the key number, position instruction value and velocity instruction value from the CPU 102, the motion controller 1000*a* outputs, to the PWM signal generation section 142*a*, a drive signal corresponding to the key number, position instruction value and velocity instruction value. Then, the PWM signal generation section 142*a* converts the drive signal into a signal of a pulse width modulation format (i.e., PWM signal) and outputs the PWM signal to the solenoid 50 corresponding to the key 1 identified by the key number. Upon receipt of the PWM signal, the solenoid 50 displaces the plunger in accordance with the PWM signal.

The A/D conversion section 141*a* converts an analog signal output from any one of the key sensors 26 into a digital signal and supplies the converted digital signal to the motion controller 1000*a*. The motion controller 1000*a* compares a position and velocity of the key 1 indicated by the signal supplied from the A/D conversion section 141 a and a position instruction value and velocity instruction value supplied from the CPU 102, and performs servo control such that the position and velocity of the key 1 and the position instruction value and velocity instruction value match each other. In this way, the key 1 is driven as instructed by the position and velocity instruction values.

The motion controller 1000*b* controls motion of the lifting rail 8. In an automatic performance, the CPU 102 supplies the motion controller 1000*b* with a position instruction value indicative of a predetermined value of the lifting rail 8 on the basis of damper pedal data that is one of performance data of the MIDI format. Upon receipt of the position instruction value, the motion controller 1000*b* outputs a drive signal, corresponding to the position instruction value, to the PWM signal generation section 142*b*. Then, the PWM signal generation section 142*b* converts the drive signal into a signal of the pulse width modulation format (i.e., PWM signal) and outputs the PWM signal to the solenoid 552. Upon receipt of the PWM signal from the motion controller 1000*b*, the solenoid 552 displaces the plunger 552*a* in accordance with the PWM signal.

The A/D conversion section 141*b* converts an analog signal output from the position sensor 555 into a digital signal and supplies the converted digital signal to the motion controller 1000*b*. The motion controller 1000*b* compares a position of the lifting rail 8 indicated by the signal supplied from the A/D conversion section 141*b* and the position instruction value supplied from the CPU 102, and performs servo control such that the position of the lifting rail 8 coincides with the position instruction value. In this way, the lifting rail 8 will be driven as instructed by the position instruction values.

Next, a description will be given about behavior of the player piano 100. First, a recording medium having stored therein performance data of the MIDI format is inserted into the access section 120 and user's operation for reproducing the performance data is performed on the operation panel 130, in response to which the CPU 102 reads out the performance data from the recording medium.

Once the CPU 102 extracts, from among the performance data, data indicating that the dampers 6 are to be released from their contact with the strings 4, it generates a position instruction value indicative of a position where the lifting rail 8 should be when the dampers 6 have been released from the contact with the strings 4. The motion controller 1000*b* outputs, to the PWM signal generation section 142*b*, a drive signal for causing the plunger 552*a* to move upward in accordance with the position instruction value. The PWM signal generation section 142*b* converts the drive signal into a PWM signal and outputs the PWM signal to the solenoid 552. Upon receipt of the PWM signal from the PWM signal generation section 142*b*, the solenoid 552 moves upward the plunger 552*a* in accordance with the PWM signal. As the plunger 552*a* moves upward, the lifting rail 8 moves upward together with the plunger 552*a* and contacts the damper levers 91 to cause the damper levers 91 to pivot As the damper levers 91 pivot, the damper wires 92 are pushed upward, in response to which the dampers 6 move away from the contact with the strings 4.

Further, once the CPU 102 extracts, from among the performance data, data indicating that the strings are to be held by the dampers 6, it generates a position instruction value indicative of a position of the lifting rail 8 when the dampers 6 should hold the strings 4. In accordance with the position instruction value, the motion controller 1000*b* stops outputting the drive signal to the PWM signal generation section 142*b*. Once the supply of the drive signal is stopped, the PWM signal generation section 142*b* stops outputting the PWM signal. Further, once the supply of the PWM signal to the solenoid 552 is stopped and electric current supply to the solenoid 552 is stopped, the plunger 552*a* moves downward back to a predetermined position, in response to which the lifting rail 8 moves downward together with the connection member 550. As the lifting rail 8 moves downward like this, the levers 91 pivot so that the damper wires 92 move downward to cause the dampers 6 to hold the strings 4. Because the dampers 6 are driven by the solenoid 552 and the connection member 550, the solenoid 552 and the connection member 550 can be said to constitute a damper drive device.

As noted above, in the piano disclosed in the Japanese Patent Application Laid-open Publication No. 2002-14669, when the dampers are to be moved by the solenoid, it is necessary for the solenoid to impart the loud lever with force greater than the biasing force imparted by the lever returning spring to the loud lever. Because relatively great force is required for moving the dampers in the prior art piano, the solenoid in the prior art piano has to be of a relatively great capacity.

In the instant embodiment, on the other hand, when the dampers 6 are to be automatically moved using the solenoid 552, the dampers 6 are moved the driving-force transmission route comprising the connection member 550, lifting rail 8 and damper mechanisms 9, and the biasing force of the returning spring (114 in FIG. 2) would not act on the transmission route. Thus, as noted above, the biasing force of the returning spring (114 in FIG. 2) would never impose a load on the electromagnetic solenoid (actuator) 552*a*. Thus, the aforementioned arrangements of the instant embodiment can reduce a load imposed on the plunger 552*a* as compared to the prior art technique, because of which the instant embodiment can employ a solenoid of a relatively small capacity and thereby reduce the size of the construction for driving the dampers 6.

Because a small-size solenoid can be employed, operating sound of the solenoid is smaller than that of a large-size solenoid, and thus, the instant embodiment can significantly reduce sound heard as noise to the user. Further, in the instant embodiment, there is no need to use a great force, such as that of the lever returning spring, that had to be used in the prior art technique.

Whereas the foregoing has described the preferred embodiment, the present invention is not limited to the above-described embodiment and may be modified variously as set forth below, and such a predetermined embodiment and modifications may be practiced in combination as necessary

[Modifications of the Actuator]

Figure 7:
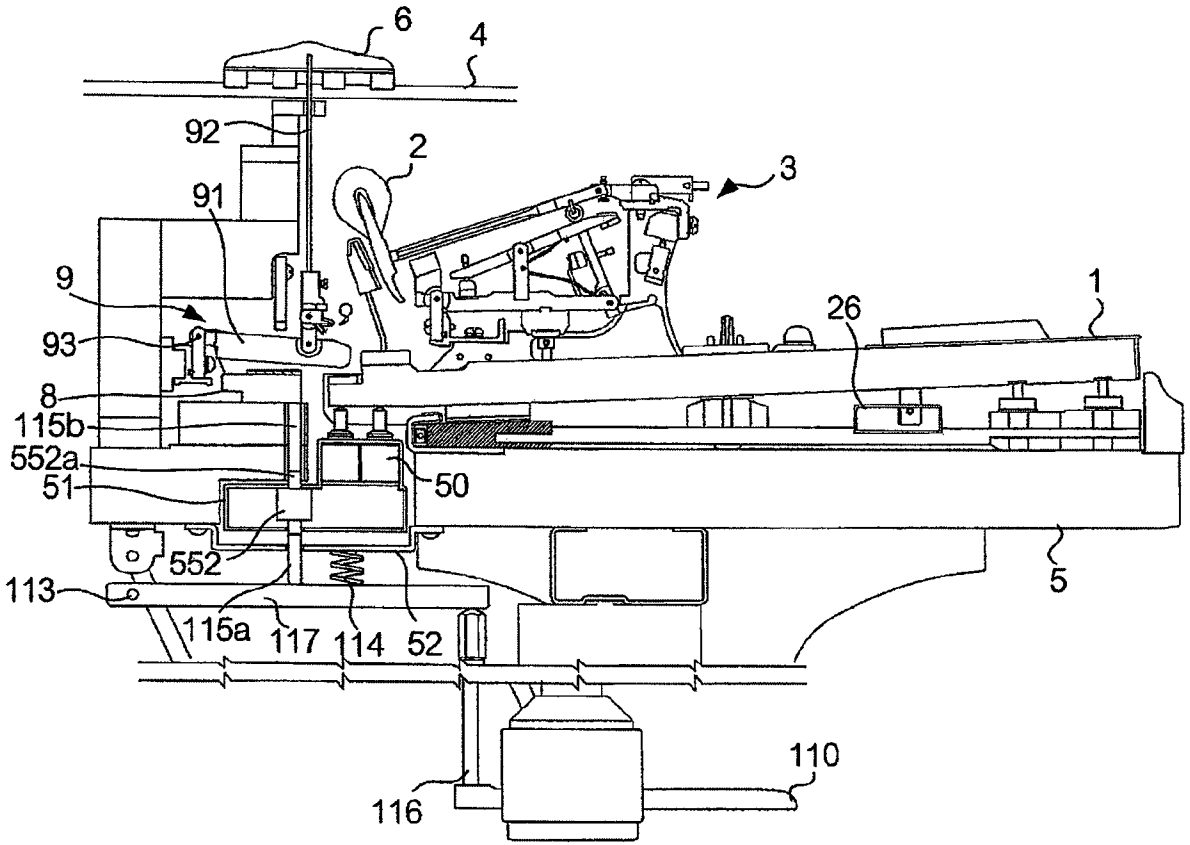
FIG. 7 is a view showing an inner construction of the player piano employing a modification of the actuator.

In the above-described preferred embodiment, the lifting rail (elongated member) 8 is driven by the solenoid 552 via the connection member 550. However, the construction for driving the lifting rail (elongated member) 8 is not so limited to the one described above. FIG. 7 is a view showing an inner construction of the grand piano 100 equipped with an automatic performance function (player piano 100) according to a modification of the present invention. In the instant modification, the solenoid 552 is disposed within the case 51, and the grand piano 100 includes two vertically divided, i.e. upper and lower, lifting rods 115*b* and 115*a*. The lower lifting rod 115*a* has a lower end contacting the upper surface of the damper pedal lever 117, and an upper end contacting the lower end of the plunger 552*a* of the solenoid 552. Further, the upper lifting rod 115*b* has a lower end contacting the upper end of the plunger 552*a* of the solenoid 552, and an upper end contacting the lower surface of the lifting rail 8. The upper lifting rod 115*b* functions as a transmission means for transmitting linear motion of the solenoid 552 to the lifting rail 8.

As the damper pedal 110 is stepped on or depressed by the human player, the damper pedal lever 117 pushes upward the lower lifting rod 115*a* so that the plunger 552*a* is pushed upward by the lower lifting rod 115*a*. Thus, the plunger 552*a* pushes upward the upper lifting rod 115*b* so that the lifting rail 8 is pushed upward by the upper lifting rod 115*b*. Because the solenoid 552 is not energized in this case, the plunger 552*a* is freely movable in the up-down direction in response to the depressing operation of the damper pedal 110.

Once the solenoid 552 is driven (energized), the plunger 552*a* moves upward to push upward the upper lifting rod 115*b*, which in turn pushes upward the lifting rail 8. When the lifting rail 8 is driven via the solenoid 552 like this, the driving force of the solenoid 552 does not act on the spring 114. Thus, with this modification too, the dampers 6 can be moved without requiring a great force.

Namely, in the modified construction of FIG. 7, the actuator (solenoid) 552 is disposed halfway on the lifting rod 115 (between the upper and lower lifting rods 115*b* and 115*a*) movable in the up-down direction for transmitting motion of the user-operated damper pedal 110 to the lifting rail (elongated member) 8, and the lifting rod 115 (115*b*) is moved in response to upward motion of the actuator (solenoid) 552 and thereby displaces upward the lifting rail (elongated member) 8.

Figure 8:
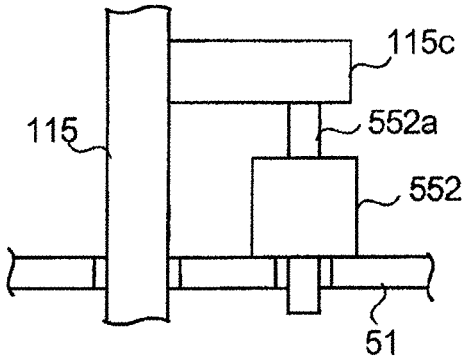
FIG. 8 is a diagram showing another modification of the actuator.

Further, in the case where the solenoid 552 for driving the lifting rail 108 is accommodated within the case 51, a modified construction of FIG. 8 may be employed. FIG. 8 is a schematic view showing in enlarged scale the interior of the case 51 from the front. Namely, in the instant modification, the lifting rod 115 has a rod (transmission rod) 115*c* connected thereto and projecting laterally and contacting the plunger 552*a* of the solenoid 552 accommodated within the case 51. If the solenoid 552 is driven, the plunger 552*a* moves upward to push the rod 115*c* upward. As the rod 115*c* is pushed upward like this, the lifting rod 115 connected with the rod 115*c* is pushed upward, so that the lifting rail 8 is pushed upward. Namely, the rod 115*c* and the lifting rod 115 function as a transmission means for transmitting linear motion of the solenoid 552 to the lifting rail 8. With this modification too, the dampers 6 can be moved without requiring a great force because the driving force of the solenoid 552 does not act on the spring 114.

Namely, in the construction of FIG. 8, the actuator (solenoid) 552 is disposed beside the lifting rod 115 that is movable in the up-down direction for transmitting motion of the user-operated damper pedal 110 to the lifting rail (elongated member) 8, and motion of the actuator (solenoid) 552 is transmitted to the lifting rod 115 (115*b*) via a transmission member (rod 115*c*) so that the lifting rail (elongated member) 8 is displaced.

Figure 9:
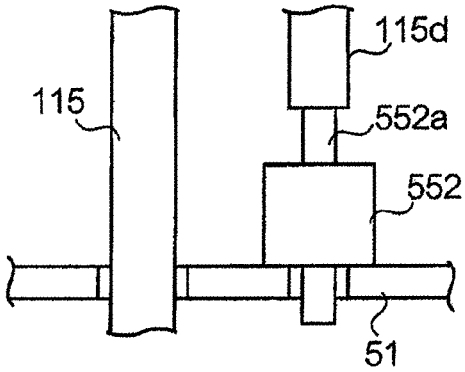
FIG. 9 is a diagram showing still another modification of the actuator.

Further, in the player piano 100, another or second lifting rod (transmission rod) separate from the lifting rod 115 may be provided, and this second lifting rod may be driven by the solenoid 552 without the lifting rod 115 being driven by the solenoid 552. FIG. 9 is a schematic diagram showing such a modified construction including the second lifting rod 115*d*. The plunger 552*a* of the solenoid 552 disposed within the case 51 is held in contact with the second lifting rod 115*d* that extends through the case 51 and the keybed 5 to contact the underside of the lifting rail 8. Here, the lifting rod 115*d* functions as a transmission means for transmitting linear motion of the solenoid 552 to the lifting rail 8. With this modification too, the dampers 6 can be moved without requiring a great force because the driving force 552 does not act on the spring 114.

Namely, in the construction of FIG. 9, the actuator (solenoid) 552 is disposed beneath the lifting rail (elongated member) 8, and the transmission rod (second lifting rod) 115*d* is provided between the actuator (solenoid) 552 and the lifting rail (elongated member) 8 so that motion of the actuator (solenoid) 552 is transmitted to the lifting rail (elongated member) 8 via the transmission rod (second lifting rod) 115*d*.

In the case where the second lifting rod (transmission rod) 115*d* is provided like this, the second lifting rod 115*d* may extend through the case 51 and the cover 52, and the solenoid 552 may be disposed underneath the cover 52 so that the second lifting rod 115 is driven by the solenoid 552. Further, in the construction where the second lifting rod 115*d* extending through the case 51 and the cover 52 is driven by the solenoid 552, a lever contacting the lower end of the lifting rod 115*d* and pivotable about a pin may be provided to be driven by the solenoid.

Whereas the above-described preferred embodiment and modifications are constructed to drive the lifting rail 8 or the lifting rod 115 by means of the solenoid, the actuator for driving the lifting rail 8 or lifting rod 115 is not limited to a linear actuator, such as a solenoid. For example, rotary motion of a rotary actuator, such as a motor, may be converted into linear motion so that the lifting rail 8 or the lifting rod 115 is driven by such converted linear motion. Alternatively, the lifting rail 8 may be displaced by a moving member of the rotary actuator without the rotary motion of the rotary actuator, such as a motor, being converted into linear motion.

Further, whereas, in the above-described preferred embodiment, the rail drive section 55 is provided on any one of the opposite longitudinal end portions of the lifting rail 8, the rail drive section 55 may be provided on both of the opposite longitudinal end portions of the lifting rail 8.

Further, whereas the preferred embodiment has been described above as applied to a grand piano as a musical instrument provided with damper mechanisms, the present invention is also applicable to an upright piano. Alternatively, the present invention may be applied to other musical instruments than pianos, such as a celesta and glockenspiel, having sounding members that vibrate in response to hitting operation by a human player or user; namely, in such a case too, the damper-driving mechanism described in relation to the preferred embodiment may be employed to drive dampers on the basis of performance data.

Furthermore, in the above-described preferred embodiment, the lifting rail 8 may be driven directly by the actuator without intervention of the transmission means. More specifically, the solenoid 552 may be disposed immediately under the lifting rail 8 so that the plunger 552*a* directly contacts the lifting rail 8. With such a modified construction, the lifting rail 8 can be driven directly by the plunger 552*a* without intervention of the transmission means.

[Modifications of the Controllers]

Figure 10:
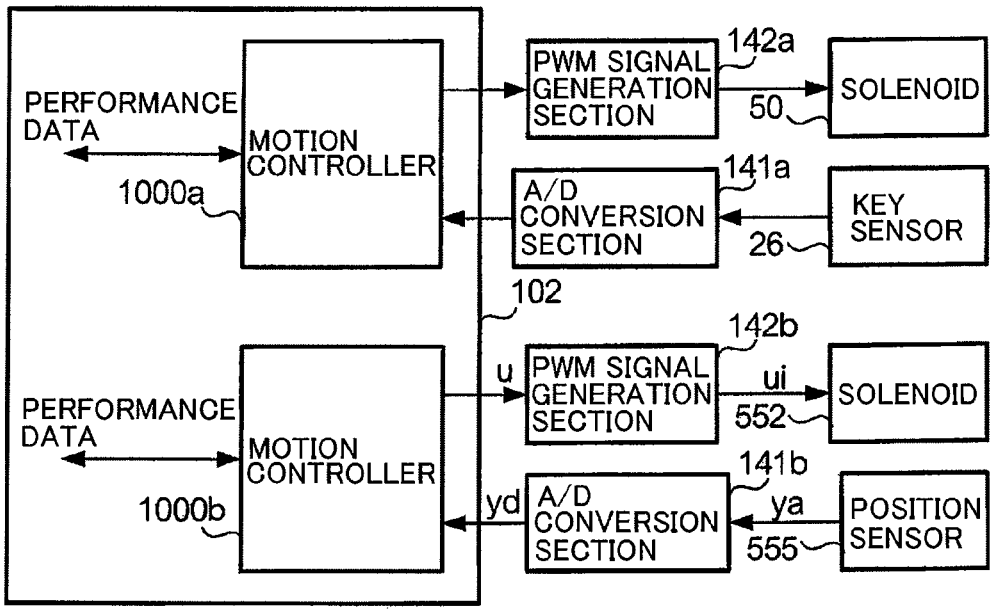
FIG. 10 is a schematic block diagram showing a modification of the functional arrangements related to the automatic performance function.

The following describe, with reference to FIGS. 10 to 13, modifications of the motion controllers 1000*a* and 1000*b* shown in FIG. 6. In FIG. 10, the motion controller 1000*a* has a function for driving a key 1 on the basis of performance data, in which case the motion controller 1000*a* acquires performance data of the MIDI format read out from a recording medium by the access section 120 (FIG. 5). Note that the performance data acquired by the motion controller 1000*a* here is a note-on/off message that is data related to driving of a key 1. Once a note-on/off message is acquired, the motion controller 1000*a* identifies a particular key 1 to be driven, but also calculates, on the basis of velocity data included in the acquired note-on/off message, a vertical position of the key 1 corresponding to the passage of time.

From a result of such calculation, the motion controller 1000*a* identifies the vertical position of the key 1 corresponding to the passage of time. Further, the motion controller 1000*a* acquires a signal supplied from the A/D conversion section 141*a* and calculates a position deviation that is a difference between a vertical position of the key 1 indicated by the signal acquired from the A/D conversion section 141*a* and the identified vertical position of the key 1. Then, the motion controller 1000*a* multiplies the calculated position deviation by a predetermined amplification factor to thereby convert a position-component control amount represented by the position deviation ex into a value corresponding to a duty ratio to be used in the PWM signal generation section 142*a*, and outputs the converted value as a control value for controlling the vertical position of the key 1. The motion controller 1000*a* also outputs a key number of the key 1 to be driven.

The PWM signal generation section 142*a* acquires the key number and control value output from the motion controller 1000*a*, converts the control value into a PWM signal and outputs the PWM signal to the solenoid 50 corresponding to the key 1 indicated by the acquired key number. Upon receipt of the PWM signal, the solenoid 50 displaces the plunger in accordance with the PWM signal to thereby drive the key 1.

The motion controller 1000*a* further includes a function for outputting, in response to a performance executed by the user, performance data of the MIDI format indicative of the performance. More specifically, once the user operates a key 1, an analog signal output from the corresponding key sensor 26 is converted into a digital signal via the A/D conversion section 141*a*, so that a signal indicative of a vertical position of the key 1 is supplied to the motion controller 1000*a*.

On the basis of the digital signal, the motion controller 1000*a* identifies the vertical position of the key 1 varying in accordance with the passage of time, determines an operating velocity of the key 1 on the basis of relationship between a time variation and the identified vertical position of the key 1, and generates velocity data of the MIDI format from the thus-determined operating velocity. Further, the motion controller 1000*a* identifies the operated key 1 and converts the key number of the operated key 1 into a note number of the MIDI format.

Furthermore, the motion controller 1000*a* generates a note-on/off message using the generated velocity data and note number data and outputs the generated note-on/off message and time information indicative of time at which the key 1 has been operated. Then, performance data of the MIDI format is generated on the basis of the note-on/off message and time information and recorded into a recording medium by the access section 120.

[First Modification of the Motion Controller 1000*b*]

Figure 11:
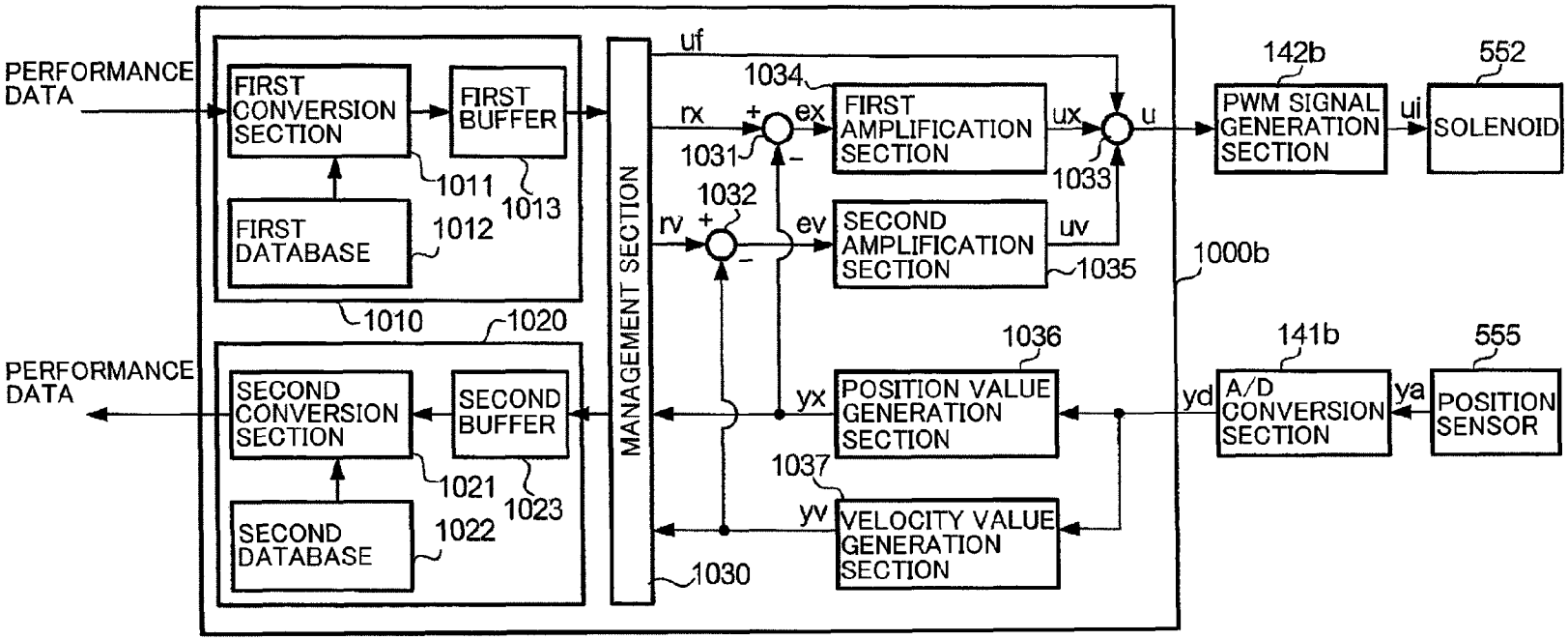
FIG. 11 is a schematic block diagram showing a first modification of a motion controller in the player piano.

The following describe a modification of the motion controller 1000*b*. FIG. 11 is a schematic block diagram showing functional arrangements of a first modification of the motion controller 1000*b*. The motion controller 1000*b* has a function for driving the dampers 6 on the basis of performance data, and a function for generating performance data indicative of user's operation of the damper pedal 110.

In FIG. 11, a position value generation section 1036 performs a smoothing process on a digital signal yd, and it outputs a value, obtained through the smoothing process, as a position value yx indicative of a position of the lifting rail 8.

A velocity value generation section 1037 generates a velocity value yv indicative of a moving velocity of the lifting rail 8. More specifically, the velocity value generation section 1037 calculates a moving velocity of the lifting rail 8 by performing a temporal differentiation process on sequentially supplied digital signals yd and outputs a velocity value yv indicative of the moving velocity of the lifting rail 8.

A performance data analysis section 1010 includes a first conversion section 1011, a first database 1012 and a first buffer 1013. The first database 1012 includes a table where various possible damper displacement amounts and vertical positions of the lifting rail 8 are prestored in association with each other.

The first conversion section 1011 acquires performance data of the MIDI format read out from a recording medium by the access section 120. The performance data acquired by the first conversion section 1011 is a control change message related to driving of the dampers 6. The first conversion section 1011 extracts a value included in the performance data, i.e. a damper displacement amount. Once the first conversion section 1011 extracts a damper displacement amount from sequentially-supplied performance data, it references the first database 1012 to acquire a value associated with the extracted damper displacement amount, i.e. acquire a vertical position of the lifting rail 8, and outputs the thus-acquired value (vertical position of the lifting rail 8) to the first buffer 1013 as a position instruction value rx.

The first buffer 1013 is a buffer for temporarily storing the position instruction value rx. For example, if the damper displacement amount differs among the sequentially-supplied performance data, and if the damper displacement amount at time point t1 is "0", the damper displacement amount at time point t2 is "64" and the damper displacement amount at time point t3 is "127", then a set of time point t1 and the position instruction value rx at time point t1, a set of time point t2 and the position instruction value rx at time point t2 and a set of time point t3 and the position instruction value rx at time point t3 are sequentially stored into the first buffer 1013 in the order of the time points.

A management section 1030 acquires the time points and position instruction values rx stored in the first buffer 1013 and outputs the acquired position instruction values rx. Further, the management section 1030 acquires the sets of time points and position instruction values rx stored in the first buffer 1013 to perform a temporal differentiation process on the acquired sets of time points and position instruction values rx to thereby calculate a moving velocity of the lifting rail 8 and output a velocity instruction value ry indicative of the moving velocity of the lifting rail 8. Also, the management section 1030 outputs a predetermined fixed value uf.

A first subtractor 1031 acquires the position instruction value rx output from the management section 1030 and the position value yx output from the position value generation section 1036. Then, the first subtractor 1031 performs an arithmetic operation of "position instruction value rx−position value yx" and outputs a position deviation ex, which is a result of the arithmetic operation, to a first amplification section 1034.

A second subtractor 1032 acquires the velocity instruction value ry output from the management section 1030 and the velocity value yv output from the velocity value generation section 1037. Then, the second subtractor 1032 performs an arithmetic operation of "velocity instruction value rv−velocity value yv" and outputs a velocity deviation ev, which is a result of the arithmetic operation, to a second amplification section 1035.

The first amplification section 1034 acquires the position deviation ex and multiplies the acquired position deviation ex by a predetermined amplification factor and outputs a result of the multiplication as a position control value ux. Here, the first amplification section 1034 performs unit conversion for converting a position-component control amount represented by the position deviation ex into a value corresponding to a duty ratio to be used in the PWM signal generation section 142*b* provided at the following stage.

The second amplification section 1035 acquires the velocity deviation ev and multiplies the acquired velocity deviation ev by a predetermined amplification factor and outputs a result of the multiplication as a velocity control value uv. Here, the second amplification section 1035 performs unit conversion for converting a velocity-component control amount represented by the velocity deviation ev into a value corresponding to a duty ratio to be used in the PWM signal generation section 142*b* provided at the following stage.

An adder 1033 adds together the fixed value uf, position control value ux and velocity control value uv and outputs a result of the addition (i.e., sum) of these values as a control value u. The control value u is a value indicative of an electric current to be supplied to the solenoid 552 (in other words, a duty ratio to be used in the PWM signal generation section 142*b*).

The PWM signal generation section 142*b* outputs a PWM signal for driving the solenoid 552. More specifically, the PWM signal generation section 142*b* generates a PWM signal ui corresponding to the above-mentioned control value u and outputs the thus-generated PWM signal ui to the solenoid 552, so that the solenoid 552 having received the PWM signal ui displaces the plunger in accordance with the PWM signal ui.

Further, in FIG. 11, a performance data generation section 1020 includes a second conversion section 1021, a second database 1022 and a second buffer 1023. The second buffer 1023 is a buffer for acquiring and storing position values yx output from the position generation section 1036 to the management section 1030. When the damper pedal 110 is operated by the user, the vertical position of the lifting rail 8 varies with the passage of time. If the damper pedal 110 is in a non-depressed or non-operated position at time point t1, in a half-depressed (i.e., half pedal) position at time point t2 and in a fully-depressed position at time point t3, respective position values yx at these time points t1 to t3 are stored into the second buffer 1023 in the order of the time points.

The second database 1022 includes a table where various possible values of the control change message of the damper pedal (i.e., damper displacement amounts) in performance data of the MIDI format and various possible positions of the lifting rail 8 are prestored in association with each other. Note that the table of the second database 1022 is the same as the table of the first database 1012. In that table of the second database 1022, for example, value "0" indicating that the dampers 6 are in an OFF state (i.e., the dampers 6 are in a state contacting the strings 4) is associated with a position value yx indicative of a position of the lifting rail 8 when the damper pedal 110 is in the non-operated or OFF position (i.e., when the dampers 6 are in contact with the corresponding strings 4), value "64" is associated with a position value yx indicative of a position of the lifting rail 8 when the damper pedal 110 is in the half-depressed position (or half pedal position), and value "127" is associated with a position value yx indicative of a position of the lifting rail 8 when the damper pedal 110 is in the fully-depressed position (i.e., when the damper 6 is remotest from the corresponding strings 4). Note that, for other positions of the damper pedal 110 between the OFF position and the half pedal position and between the half pedal position and the fully-depressed position as well, position values yx and possible values of the control change message are associated with each other.

The second conversion section 1021 references the second database 1022 to acquire a damper displacement amount associated with the position value yx stored in the second buffer 1023. Namely, by referencing the second database 1022, the second conversion section 1021 converts the position value yx into a dimensionless damper displacement amount. Then, the second conversion section 1021 outputs performance data of the MIDI format including the acquired damper amount, and such performance data output from the second conversion section 1021 becomes a control change message pertaining to the driving of the dampers 6.

[Behavior of the First Modification]

The following describe example behavior of the player piano 100 employing the first modification of the motion controller 1000*b* shown in FIG. 11. Particularly, the following describe behavior of the player piano 100 when motion of the dampers 6 responsive to a user's performance is to be stored as performance data, and behavior when the dampers 6 are to be driven on the basis of performance data stored in a recording medium.

[Behavior when Motion of the Dampers 6 Responsive to a User's Performance is to be Stored as Performance Data]

If the user performs, on the operation panel 130, operation for instructing storage of performance data, performance data representative of a performance executed by the user will be recorded into a recording medium inserted in the access section 120. For example, as the user depresses a front end portion of the damper pedal 110, a rear end portion of the damper pedal 110 moves upward, causing the pedal rod 116 to move upward. By the upward movement of the pedal rod 116, a front end portion of the damper pedal lever 117 is pushed upward so that the lever 117 pivots to thereby push up the lifting rod 115. As the lifting rod 115 is pushed upward like this, the lifting rail 8 is pushed upward.

As the vertical position of the lifting rail 8 varies in the aforementioned manner, the light-permeable plate 555*a* varies in position, so that the analog signal ya output from the detection section 555*b* varies. Such an analog signal ya is sampled and sequentially converted into digital signals yd by the A/D conversion section 141*b*. The digital signals yd obtained by the A/D conversion section 141*b* are sequentially output to the position value generation section 1036. The position value generation section 1036 performs the smoothing process on the sequentially-supplied digital signals yd and thereby outputs a position value yx indicative of a position of the lifting rail 8. Such a position value yx too varies in response to operation of the damper pedal 110 because the position of the lifting rail 8 varies in response to the operation of the damper pedal 110.

The position value yx output from the position value generation section 1036 is supplied via the management section 1030 to the second buffer 1023 for storage therein. The second conversion section 1021 acquires, from the second database 1022, a damper displacement amount associated with the position value yx stored in the second buffer 1023 and outputs performance data of the MIDI format including the acquired damper amount. Such performance data output from the second conversion section 1021 becomes a control change message pertaining to the driving of the dampers 6. The CPU 102 controls the access section 120 to store, into the recording medium, the performance data together with information indicative of a performance time.

[Behavior when the Dampers 6 are to be Driven on the Basis of Performance Data]

The following describe behavior of the piano 100 when the dampers 6 are to be driven on the basis of performance data stored in a recording medium. First, once a recording medium having stored therein performance data of the MIDI format is inserted into the access section 120 and user's operation for reproducing the performance data from the recording medium is performed on the operation panel 130, the CPU 102 reads out the performance data from the recording medium. If, at that time, a control change message pertaining to the driving of the dampers 6 is read out as the performance data, that performance data is supplied to the first conversion section 1011.

Once the first conversion section 1011 extracts a damper displacement amount from the acquired performance data, it converts the extracted damper displacement amount into a position instruction value rx indicative of a position of the lifting rail 8 by referencing the first database 1012. The position instruction value rx is stored into the first buffer 1013. if the damper displacement amount at time point t1 is "0", the damper displacement amount at time point t2 is "64" and the damper displacement amount at time point t3 is "127", then a set of time point t1 and the position instruction value rx at time point t1, a set of time point t2 and the position instruction value rx at time point t2 and a set of time point t3 and the position instruction value rx at time point t3 are sequentially stored into the first buffer 1013 in the order of the time points.

Once the position instruction value rx is stored into the first buffer 1013, the management section 1030 acquires the time and position instruction value rx stored in the management section 1030 and outputs the acquired position instruction value rx. Further, the management section 1030 sequentially acquires the sets of the times and position instruction values rx stored in the second buffer 1013, performs temporal differentiation thereon to calculate a moving velocity of the lifting rail 8 and outputs a velocity instruction value ry indicative of the moving velocity.

The position sensor 555 outputs an analog signal ya indicative of a vertical position of the lifting rail 8, and such an analog signal ya is sequentially converted by the A/D conversion section 141*b* into digital signals yd, on the basis of which the position value generation section 1036 outputs a position value yx indicative of the position of the lifting rail 8. The velocity value generation section 1037 calculates a moving velocity of the lifting rail 8 by performing a temporal differentiation process on the digital signals yd, and then, it outputs a velocity value yv indicative of the calculated moving velocity of the lifting rail 8.

The first subtractor 1031 acquires the position instruction value rx output from the management section 1030 and the position value yx output from the position value generation section 1036 and performs an arithmetic operation of "position instruction value rx−position value yx" to thereby output a position deviation ex, which is a result of the arithmetic operation, to the first amplification section 1034. The second subtractor 1032 acquires the velocity instruction value ry output from the management section 1030 and the velocity value yv output from the velocity value generation section 1037. Then, the second subtractor 1032 performs an arithmetic operation of "velocity instruction value rv−velocity value yv" and outputs a velocity deviation ev, which is a result of the arithmetic operation, to the second amplification section 1035.

The first amplification section 1034 acquires the position deviation ex and multiplies the acquired position deviation ex by a predetermined amplification factor and outputs a result of the multiplication as a position control value ux. Further, the second amplification section 1035 acquires the velocity deviation ev and multiplies the acquired velocity deviation ev by a predetermined amplification factor and outputs a result of the multiplication as a velocity control value uv. The adder 1033 adds together the fixed value uf, position control value ux and velocity control value uv and outputs a result of the addition (i.e., sum) of these values as a control value u to the PWM signal generation section 142*b*. The PWM signal generation section 142*b* outputs a PWM signal ui corresponding to the above-mentioned control value u and outputs the thus-generated PWM signal ui to the solenoid 552, so that the solenoid 552 displaces the plunger in accordance with the PWM signal ui.

As the plunger 552*a* is displaced, the light-permeable plate 555*a* and the lifting rail 8 are displaced together with the connection member 550. In response to the displacement (positional variation) of the light-permeable plate 555*a*, the analog signal ya output from the detection section 555*b* varies. This analog signal ya is converted into a digital signal yd, and the converted digital signal yd is supplied to the position value generation section 1036 and velocity value generation section 1037. Then, a position value yx corresponding to the digital signal yd is fed back to the first subtractor 1031 while a velocity value yv corresponding to the digital signal yd is fed back to the second subtractor 1032, so that a control value u is output such that the position deviation ex and the velocity deviation ev decrease.

In the instant embodiment, when an automatic performance is to be executed on the basis of performance data, the dampers 6 are driven by the lifting rail 8 being driven or moved by the solenoid 552. As compared to the prior art construction where the damper pedal is driven by the solenoid to move the dampers, the instant embodiment of the present invention can move the dampers with an increased accuracy because there are fewer component parts between the component part driven by the solenoid and the dampers.

[Second Modification of the Motion Controller 1000*b*]

Figure 12:
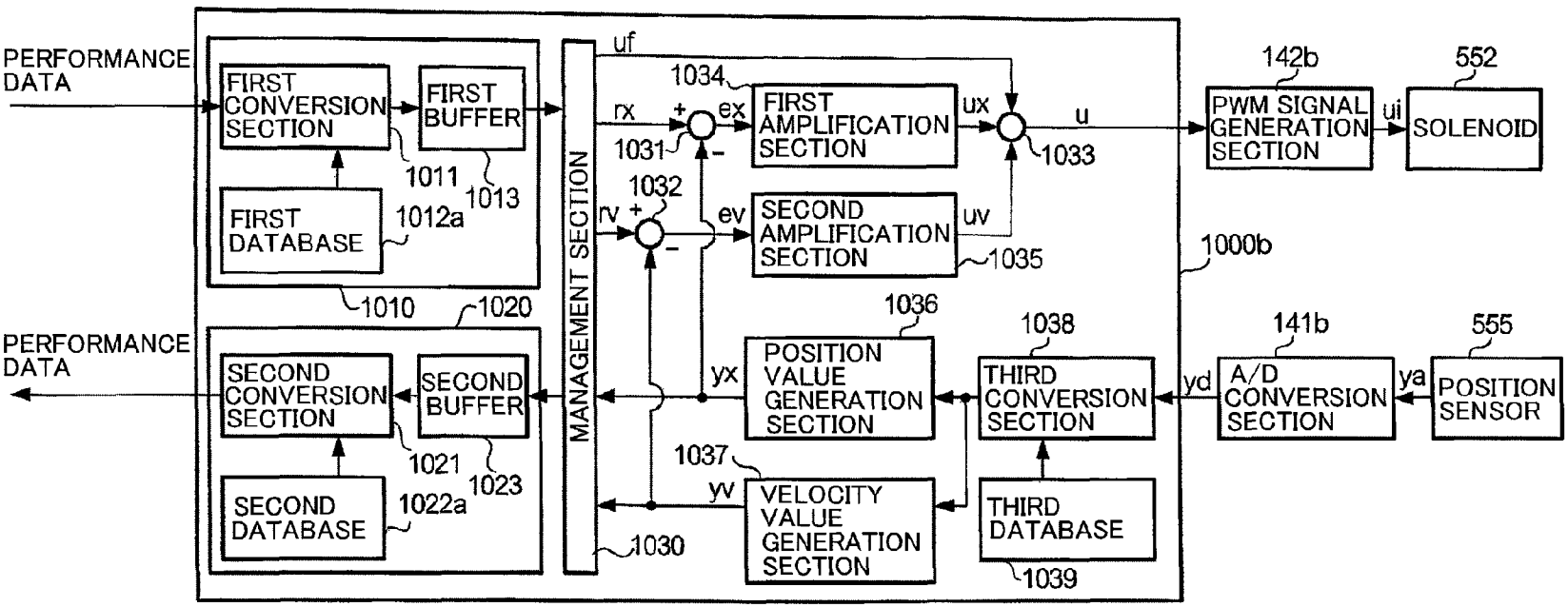
FIG. 12 is a schematic block diagram showing a second modification of the motion controller in the player piano.

The following describe, with reference to FIG. 12, a second modification of the motion controller 1000*b*. In FIG. 12, the motion controller 1000*b* includes a third conversion section 1038 and a third database 1039. Further, the instant modification of the motion controller 1000*b* includes a first database 1012*a* and a second database 1022*a* similar to the ones described above.

The third database 1039 includes a table in which various values of the digital signal yd and various vertical positions of the lifting rail 8 are prestored in association with each other. Let it be assumed here that a position of the lifting rail 8 when the lifting rail 8 is not pushed upward by the lifting rod 115 and plunger 552*a* is set in advance as a reference vertical position of the lifting rail 8 and that such a reference vertical position of the lifting rail 8 is "0 mm". A predetermined value of the digital signal yd when the lifting rail 8 is in the "0 mm" reference position is prestored in the table in association with the "0 mm" reference position. Let it also be assumed that the upwardmost position of the lifting rail 8 moved by the lifting rod 115 and plunger 552*a* is 10 mm above the "0 mm" reference position, in which case a predetermined value of the digital signal yd when the lifting rail 8 is in the "10 mm" position is prestored in the third database 1039 in association with the "10 mm" position. For other positions between the "0 mm" reference position and the "10 mm" position as well, values of the digital signal yd and vertical positions of the lifting rail 8 are prestored in association with each other.

The third conversion section 1038 references the third database 1039 to acquire a position value associated with the digital signal yd acquired from the A/D conversion section 141*b*. Namely, by referencing the third database 1039, the conversion section 1038 converts the digital signal yd into a physical amount indicating a position of the lifting rail 8 in millimeters (mm). The conversion section 1038 supplies the thus-acquired position value to the position value generation section 1036 and velocity value generation section 1037.

Because what is supplied to the position value generation section 1036 is a position value in mm (i.e., in the unit of mm), a position value yx supplied from the position value generation section 1036 to the second buffer 1023 and first subtractor 1031 too is in the unit of mm. Similarly, because what is supplied to the velocity value generation section 1037 is a position value in mm, a velocity value yv output from the velocity value generation section 1037 is a physical amount in the unit of mm/s.

The first database 1012*a* includes a table where various possible damper displacement amounts and vertical positions of the lifting rail 8 are prestored in association with each other. Note that the first database 1012*a* is different from the aforementioned first database 1012 in that the vertical positions of the lifting rail 8 stored in the first database 1012*a* are physical amounts in mm.

The first conversion section 1011 acquires a control change message pertaining to the driving of the dampers 6. Once the first conversion section 1011 extracts a damper displacement amount from among sequentially-acquired performance data, the first conversion section 1011 references the first database 1012*a* to acquire a value in mm, i.e. vertical position of the lifting rail 8, associated with the extracted damper displacement amount, and it outputs the acquired value to the first buffer 1013 as a position instruction value rx. Because the position instruction value stored in the first buffer 1013 is a physical amount in mm, the position instruction value rx output from the management section 1030 too is a physical amount in mm, and the velocity instruction value ry output from the management section 1030 is a physical amount in the unit of mm/s.

The second database 1022*a* includes a table where various possible damper displacement amounts and positions of the lifting rail 8 are prestored in association with each other. Note that the second database 1022*a* is different from the aforementioned first database 1012 in that the positions of the lifting rail 8 stored in the second database 1022*a* are physical amounts in mm.

The second conversion section 1021 references the second database 1022*a* to acquire a damper displacement amount associated with the position instruction value yx stored in the second buffer 1023. Namely, by referencing the second database 1022, the second conversion section 1021 converts the position value yx, which is a physical amount in mm, into a dimensionless damper displacement amount. Then, the second conversion section 1021 outputs performance data of the MIDI format including the acquired damper amount, and such performance data output from the second conversion section 1021 becomes a control change message pertaining to the driving of the dampers 6.

The second modification is different from the first modification in that, whereas the position value yx, position instruction value rx, velocity value yv and velocity instruction value ry are dimensionless values in the first modification, such values are physical amounts in mm or mm/s in the second modification. Note that behavior of the servo control in the second modification is the same as in the first modification and thus will not be described here to avoid unnecessary duplication.

With the above-described second modification, where the servo control is performed using physical amounts in mm or mm/s rather than dimensionless values, the lifting rail 8 can be moved with same displacement amounts even where the aforementioned modified construction is applied to different types of pianos.

[Third Modification of the Motion Controller 1000*b*]

Figure 13:
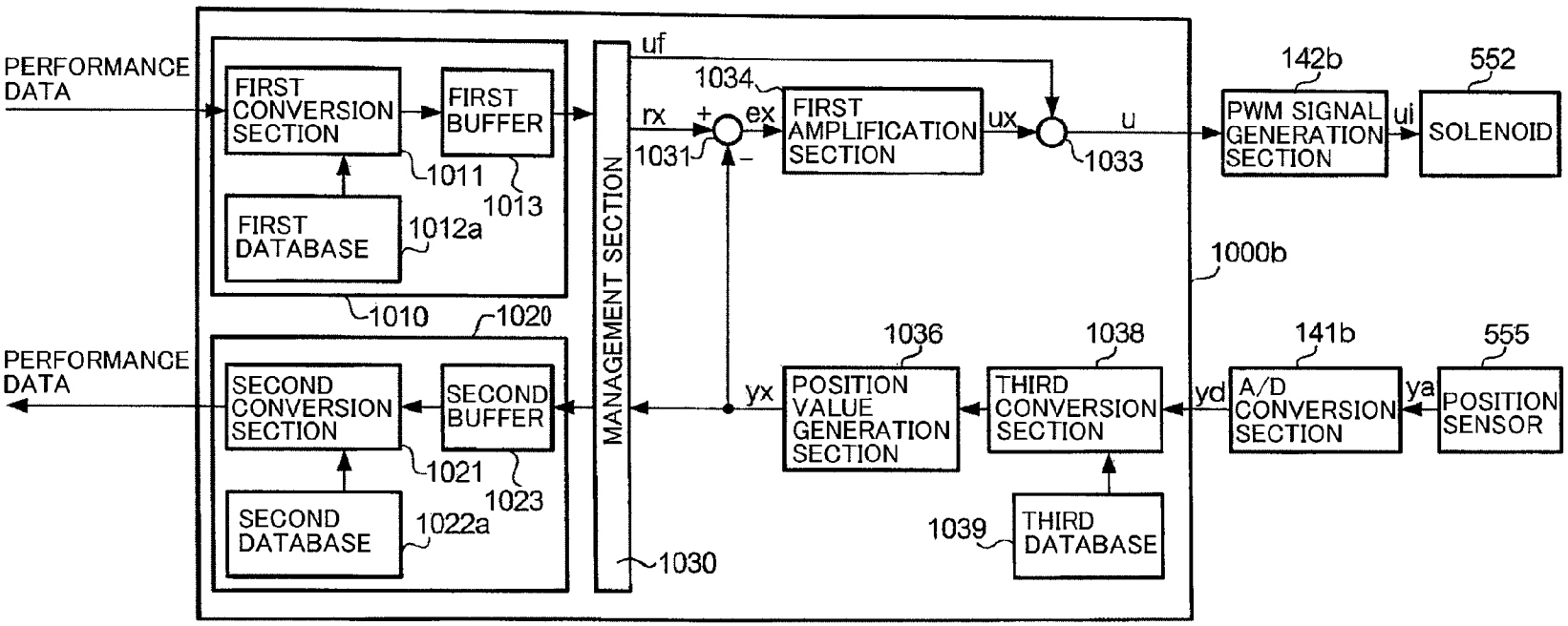
FIG. 13 is a schematic block diagram showing a third modification of the motion controller in the player piano.

The following describe, with reference to FIG. 13, a third modification of the motion controller 1000*b*. The third modification shown in FIG. 13 is different from the second modification shown in FIG. 12 in that it does not include the velocity value generation section 1037, second subtractor 1032 and second amplification section 1035 provided in the second modification. Because the third modification does not include the blocks for processing the velocity instruction value ry and velocity value yv, position control using no velocity-related information is performed in the third modification.

More specifically, a damper displacement amount included in performance data supplied to the first conversion section 1011 is converted into a physical amount in mm (millimeters), then stored into the first buffer 1013 and then supplied to the first subtractor 1031 via the management section 1030. The first subtractor 1031 obtains a position deviation ex using the position instruction value rx supplied from the management section 1030 and the position value yx supplied from the position value generation section 1036, and then it outputs the thus-obtained position deviation ex to the first amplification section 1034. The first amplification section 1034 outputs a position control value ux in the same manner as in the first medication. Because the second amplification section 1035 is not provided in the third modification, the adder 1033 in the third modification adds together the fixed value of and the position control value ux and outputs a result of the addition (sum) as the control value u. The control value u is a value indicative of an electric current to be supplied to the solenoid 552. Then, in the same manner as in the first modification, the solenoid 552 is driven on the basis of the control value u, so that the position of the lifting rail 8 is controlled. Because the velocity value yv is not used, and thus, third modification behaves in the same manner as the second embodiment when performance data is to be stored.

Because the third modification does not perform control using the velocity value yv and velocity instruction value rv, the motion controller 1000*b* can be simplified in construction. Whereas the third modification of the motion controller 1000*b* is shown in FIG. 13 as including the third conversion section 1038 and the third database 1039, the third conversion section 1038 and the third database 1039 may be dispensed with, in which case the third modification of the motion controller 1000*b* may include the first database 1012 of the first modification in place of the first database 1012*a* and include the second database 1022 of the first modification in place of the second database 1022*a*.

Whereas the preferred embodiment has been described above in relation to the case where the position sensor 555 detects a vertical position of a right end portion (as viewed from the human player) of opposite longitudinal end portions of the lifting rail 8, the position sensor 555 mat detect a vertical position of a left end portion (as viewed from the human player) of the lifting rail 8. Alternatively, such position sensors 555 may be provided on both of the opposite longitudinal end portions of the lifting rail 8 for detecting vertical positions of the opposite end portions. In such a case, the position value generation section 1036 may calculate an average value of digital signals yd obtained by digital conversion of analog signals output from the two position sensors 555 and determine a position value yx based on the calculated average value. Alternatively, the position sensor 555 may be provided on a longitudinally middle portion of the lifting rail 8. As another alternative, the position sensor 555 may be provided on middle and left end portions, or middle and right end portions, or middle and left and right end portions of the lifting rail 8. Further, in the case where a plurality of the position sensors 555 are provided, the number of the position sensors 555 is not limited to two or three, and four or more position sensors 555 may be provided on not only opposite longitudinal end portions and middle portion of the lifting rail 8 but also one or more other portions of the lifting rail 8. Further, instead of the position sensor 555 being disposed on the frame 551, the light-permeable plate 555*a* of the position sensor 555 may be disposed on the upper surface of the lifting rail 8 and the detection section 555*b* of the position sensor 555 may be disposed over the lifting rail 8.

Whereas, in the above-described preferred embodiment, the position sensor 555 is constructed to detect a position of the lifting rail 8 by use of light, the present invention is not so limited, and the position sensor 555 may be constructed to detect a position of the lifting rail 8 by use of a linear potentiometer detecting a linear position, or by use of magnetism, or the like.

Furthermore, in the above-described preferred embodiment, where the position sensor 555 is constructed to detect a vertical position of the lifting rail 8, the transparent or light-permeable plate 555*a* of the position sensor 555 may be provided on the outer peripheral surface of the lifting rod 115 along the longitudinal direction of the lifting rod 115 in such a manner that a vertical position of the lifting rod 115 can be detected by the light-permeable plate 555*a* passing between the light emitting portion and the light receiving portion of the position sensor 555. Because the lifting rod 115 is displaced together with the lifting rail 8, it may be said that this modified arrangement indirectly detects a position of the lifting rail 8, although the modified arrangement actually detects a position of the lifting rod 115.

Furthermore, whereas the above-described preferred embodiment is constructed in such a manner that performance data output from the motion controller 1000*b* are stored into a recording medium inserted in the access section 120, an interface for performing communication with another external device may be provided in the controller 10 in such a manner that performance data can be output to the other external device via the interface. Further, in such a case, performance data may be acquired from the other external device via the interface and supplied to the motion controllers 1000*a* and 1000*b*.

Furthermore, whereas the above-described preferred embodiment is constructed to perform the servo control, using the motion controller 1000*b*, position sensor 555 and A/D conversion section 141*b*, to control the solenoid 552, the construction for controlling the solenoid 552 is not so limited. For example, the CPU 102 may output a drive signal to the PWM signal generation section 142*b* so that the position of the plunger 552*a* can be controlled in an open-loop manner.

In the performance data of the MIDI format, some of the data related to the damper pedal is data indicative of the half-pedal state. When performance data is indicative of the half-pedal state, the position of the plunger 552*a* may be controlled, on the basis of a position of the pedal indicated by the data, to reproduce the half-pedal state.

This application is based on, and claims priorities to, JP PA 2012-008402 filed on 18 Jan. 2012 and JP PA 2012-008403 filed on 18 Jan. 2012. The disclosure of the priority applications, in its entirety, including the drawings, claims, and the specification thereof, are incorporated herein by reference.

What is claimed is:

1. A damper drive device for a musical instrument, the damper drive comprising:

a plurality of dampers each configured to be displaceable to damp vibration of a corresponding sounding member of the musical instrument;

a plurality of damper levers each configured to be pivotable to displace a corresponding one of the dampers;

an elongated member configured to be displaceable to collectively pivot the plurality of damper levers;

an actuator disposed beside the elongated member for displacing the elongated member; and a connection member mounted to the elongated member, wherein the elongated member is displaced in response to driving of the actuator so that the dampers are displaced away from contact with the sounding members, wherein motion of the actuator is transmitted to the elongated member to apply driving force to a longitudinal edge portion of the elongated member so that the elongated member pivots about a longitudinal axis thereof, and wherein the connection member is mounted to the elongated member and projects generally laterally from the longitudinal edge portion of the elongated member to transmit motion of the actuator to the elongated member, the driving force being applied to the longitudinal edge portion of the elongated member by the actuator driving the connection member.

2. A damper drive device for a musical instrument, the damper drive comprising:

a plurality of dampers each configured to be displaceable to damp vibration of a corresponding sounding member of the musical instrument;

a plurality of damper levers each configured to be pivotable to displace a corresponding one of the dampers;

an elongated member configured to be displaceable to collectively pivot the plurality of damper levers; and an actuator disposed beside or underneath the elongated member for displacing the elongated member, wherein the elongated member is displaced in response to driving of the actuator so that the dampers are displaced away from contact with the sounding members, wherein the actuator is disposed halfway on a lifting rod vertically movable for transmitting motion of a user-operated damper pedal to the elongated member, and wherein the lifting rod is moved upwardly, in response to upward movement of the actuator, to displace the elongated member.

3. The damper drive device as claimed in claim 2, wherein motion of the actuator is transmitted to the elongated member to apply driving force to a longitudinal edge portion of the elongated member so that the elongated member pivots about a longitudinal axis thereof.

4. A damper drive device for a musical instrument, the damper drive comprising:

a plurality of dampers each configured to be displaceable to damp vibration of a corresponding sounding member of the musical instrument;

a plurality of damper levers each configured to be pivotable to displace a corresponding one of the dampers;

an elongated member configured to be displaceable to collectively pivot the plurality of damper levers; and an actuator disposed beside or underneath the elongated member for displacing the elongated member, wherein the elongated member is displaced in response to driving of the actuator so that the dampers are displaced away from contact with the sounding members, wherein the actuator is disposed beside a lifting rod vertically movable for transmitting motion of a user-operated damper pedal to the elongated member, and motion of the actuator is transmitted to the lifting rod via a transmission member to displace the elongated member.

5. A damper drive device for a musical instrument, the damper drive comprising:

a plurality of dampers each configured to be displaceable to damp vibration of a corresponding sounding member of the musical instrument;

a plurality of damper levers each configured to be pivotable to displace a corresponding one of the dampers;

an elongated member configured to be displaceable to collectively pivot the plurality of damper levers;

an actuator disposed underneath the elongated member for displacing the elongated member; and a transmission rod, wherein the elongated member is displaced in response to driving of the actuator so that the dampers are displaced away from contact with the sounding members, wherein the transmission rod is provided between the actuator and the elongated member for transmitting motion of the actuator to the elongated member, motion of the actuator being transmitted to the elongated member via the transmission rod.

6. A damper drive device for a musical instrument, the damper drive comprising:

a plurality of dampers each configured to be displaceable to damp vibration of a corresponding sounding member of the musical instrument;

a plurality of damper levers each configured to be pivotable to displace a corresponding one of the dampers;

an elongated member configured to be displaceable to collectively pivot the plurality of damper levers; and an actuator disposed beside or underneath the elongated member for displacing the elongated member, wherein the elongated member is displaced in response to driving of the actuator so that the dampers are displaced away from contact with the sounding members, wherein the musical instrument includes:

a damper pedal operable by a user;

a pedal rod upwardly displaceable in response to depressing operation of the damper pedal;

a resilient member normally urging the pedal rod downwardly;

a damper pedal lever pivotally movable in response to displacement of the pedal rod;

a lifting rod movable vertically in response to pivotal movement of the damper pedal lever, wherein the elongated member is displaced in response to vertical movement of the lifting rod, and wherein motion of the actuator is linearly transmitted to the lifting rod or the elongated member.

7. The damper drive device as claimed in claim 2, further comprising a sensor configured to detect a displaced position of the elongated member.

8. The damper drive device as claimed in claim 7, further comprising a control section configured to control driving of the actuator in accordance with an instruction value instructing a displaced position of the elongated member.

9. A damper drive device for a musical instrument, the damper drive comprising:

a plurality of dampers each configured to be displaceable to damp vibration of a corresponding sounding member of the musical instrument;

a plurality of damper levers each configured to be pivotable to displace a corresponding one of the dampers;

an elongated member configured to be displaceable to collectively pivot the plurality of damper levers;

an actuator disposed beside or underneath the elongated member for displacing the elongated member;

a sensor configured to detect a displaced position of the elongated member; and a control section configured to control driving of the actuator in accordance with an instruction value instructing a displaced position of the elongated member, wherein the elongated member is displaced in response to driving of the actuator so that the dampers are displaced away from contact with the sounding members, wherein the control section controls the driving of the actuator on the basis of position data detected by the sensor and the instruction value, so that the elongated member is positioned at a position corresponding to the instruction value.

10. The damper drive device as claimed in claim 9, further comprising a storage section configure to store therein position data detected by the sensor.

11. A damper drive device for a musical instrument, the damper drive comprising:

a plurality of dampers each configured to be displaceable to damp vibration of a corresponding sounding member of the musical instrument;

a plurality of damper levers each configured to be pivotable to displace a corresponding one of the dampers;

an elongated member configured to be displaceable to collectively pivot the plurality of damper levers;

an actuator disposed beside or underneath the elongated member for displacing the elongated member; and a sensor configured to detect a displaced position of the elongated member, wherein the elongated member is displaced in response to driving of the actuator so that the dampers are displaced away from contact with the sounding members, wherein the sensor equivalently detects a displaced position of the elongated member by detecting a displaced position of a transmission member for transmitting a motion to the elongated member.

12. A musical instrument comprising:

a plurality of sounding members;

a plurality of dampers each configured to be displaceable to damp vibration of any one of the sounding members;

a plurality of damper levers each configured to be pivotable to displace a corresponding one of the dampers;

an elongated member configured to be displaceable to collectively pivot the plurality of damper levers;

a damper pedal operable by a user;

a pedal mechanism configured to displace the elongated member in response to depressing operation of the damper pedal so that the dampers are displaced away from contact with the sounding members;

a sensor configured to detect a displaced position of the elongated member; and an actuator disposed besides one end of the elongated member and configured to drive the elongated member.

13. The musical instrument as claimed in claim 12, further comprising a storage section configured to store position data detected by the sensor.

14. The musical instrument as claimed in claim 12, further comprising a control section configured to control driving of the actuator in accordance with an instruction value instructing a displaced position of the elongated member and position data detected by the sensor, so that the elongated member is positioned at a position corresponding to the instruction value.

15. The musical instrument as claimed in claim 12, further comprising a connecting member that connects to the one end of the elongated member and configured to be driven by the actuator and to drive the elongated member upon being driven by the actuator.

* * * * *